US006585099B2

(12) United States Patent
Babler et al.

(10) Patent No.: US 6,585,099 B2
(45) Date of Patent: Jul. 1, 2003

(54) LUBRICATING DEVICE FOR AN ESCALATOR OR A MOVING WALKWAY WITH MOVING LUBRICATION POINTS

(75) Inventors: Walter Babler, Perchtoldsdorf (AT); Michael Matheisl, Vienna (AT)

(73) Assignee: Inventio AG, Hergiswil (CH)

( * ) Notice: Subject to any disclaimer, the term of this patent is extended or adjusted under 35 U.S.C. 154(b) by 46 days.

(21) Appl. No.: 09/817,853

(22) Filed: Mar. 26, 2001

(65) Prior Publication Data

US 2001/0045340 A1 Nov. 29, 2001

(30) Foreign Application Priority Data

Mar. 27, 2000 (EP) ..... 00810261

(51) Int. Cl.[7] ..... B66B 23/12
(52) U.S. Cl. ..... 198/333; 198/500
(58) Field of Search ..... 198/321, 333, 198/500; 184/5, 12

(56) References Cited

U.S. PATENT DOCUMENTS 6,471,033 B2 * 10/2002 Ulrich ..... 198/321
6,471,034 B2 * 10/2002 Lunardi et al. ..... 198/333

OTHER PUBLICATIONS

Patent Abstracts of Japan, "Escalator With Sliding Agent Coating Function" Pub. No. 8225285, Sep. 3, 1996 (with attached patent copy).

Patent Abstracts of Japan, "Lubricant Coating Device For Escalator", Pub. No. 10109874, Apr. 28, 1998.

ESP@CENET Database "Guide Rail Oil Feeding Device For Passenger Conveyor", JP 5319767, pub. Mar. 12, 1993.

* cited by examiner

*Primary Examiner*—Joseph E. Valenza
(74) *Attorney, Agent, or Firm*—Schweitzer Cornman Gross & Bondell LLP

(57) ABSTRACT

A lubricating device incorporated in an escalator step of an escalator or in a moving walkway plate of a moving walkway, has lubrication points formed by lubricating siding pads or brushes which are arranged at the escalator step or the moving walkway plate and which project slightly beyond the side edges of the escalator step or the moving walkway plate. The pads or brushes have a bore through which the lubricant is transferred to base plates forming lateral boundaries for the steps or plates.

4 Claims, 3 Drawing Sheets

LUBRICATING DEVICE FOR AN ESCALATOR OR A MOVING WALKWAY WITH MOVING LUBRICATION POINTS

The present invention relates to a lubricating device for an escalator or a moving walkway, wherein a step belt of the escalator or a plate belt of the moving walkway is guided between lateral borders and wherein at least one lubricant container is provided at at least one escalator step of the step belt or moving walkway plate of the plate belt and is connected with lubrication points for the step or plate.

BACKGROUND OF THE INVENTION

Lubricating devices of the identified general type have the purpose of preventing the increase of friction and the development of noise between the escalator/moving walkway base plates and the step or plate belt as a result of environmental contaminating deposits, which are virtually unavoidable, and which may include dust, abrasives from subway brakes, etc., which collect at base plates of the escalator or moving walkway, as well as deposits from material deterioration.

Japanese patent specification JP 5319767 discloses a lubricating device for escalators by means of which guide rails for the step belt of an escalator can be lubricated For this purpose there is provided a solenoid valve which is supplied with power by a battery and which is arranged at an outlet opening of an oil container fastened to an escalator step. A pipe, by way of which the guide rail for the rear wheel of the escalator step is lubricated, is connected to the valve. A flexible hose, through which the lubricant of the guide rail for the front wheel of the escalator step is fed, branches from the pipe. A timer is provided for control of the valve. Fault-free lubrication at the sides of the escalator is not guaranteed.

Japanese patent specification JP 08225285 discloses another lubricating device for an escalator, in which lubricating agent holders are provided at the side edges of the rear side of the tread and riser of an escalator step. Bristles, which form brushes and which contact the side walls of the escalator, protrude out of the lubricating agent holders. A lubricating agent container fastened to the rear side of the tread is connected with the lubricating agent holders or brushes by way of pipes and wicks inserted therein. A relatively large amount of lubricating agent is consumed by the long brush formed by means of the bristles; a wide lubricating track, which is only partly covered by the step belt, is formed.

BRIEF DESCRIPTION OF THE INVENTION

It is an object of the present invention to provide a lubricating device of the general kind set forth in which sliding pads or brushes are utilized to lubricate base plates. Wear of the sliding pads is reduced and damage to the base plates is prevented. The construction of the lubricating device is very simple and therefore economical. The lubricant track formed by the sliding pads or brushes is covered and relatively narrow and therefore lubricant-conserving.

The foregoing and other objects are met by a lubricating device in which lubricant points are formed by a lubricant dispenser means in the form of lubricating sliding pads which are arranged at the escalator step or moving walkway plate and which project slightly beyond the side edges of the step or plate. The pads have a bore through which the lubricant is transferred to base plates forming the lateral borders for the steps or plates.

The lubricant dispenser means may alternatively be formed by brushes which are arranged at the escalator step or moving walkway plate and which project slightly beyond the side edges of the step or plate and have a bore through which the lubricant is transferred into the bristles of the brush and therefrom to the base plates.

As those skilled in the art will recognize that the object, effect and execution of the present invention are essentially identical in application to both escalators and moving walkways, for the sake of simplicity only its application to escalators will be described hereinafter.

BRIEF DESCRIPTION OF THE DRAWINGS

The invention is more fully explained in the following disclosure of embodiments thereof in conjunction with the annexed drawings, in which.

DETAILED DESCRIPTION OF THE INVENTION

Figure 1:
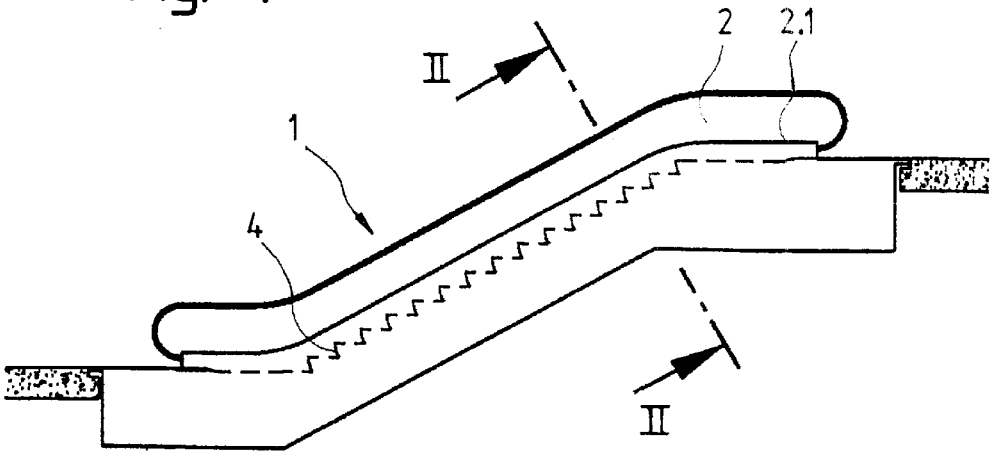
FIG. 1 is a simplified representation of a side view of an escalator incorporating the invention.
Figure 2:
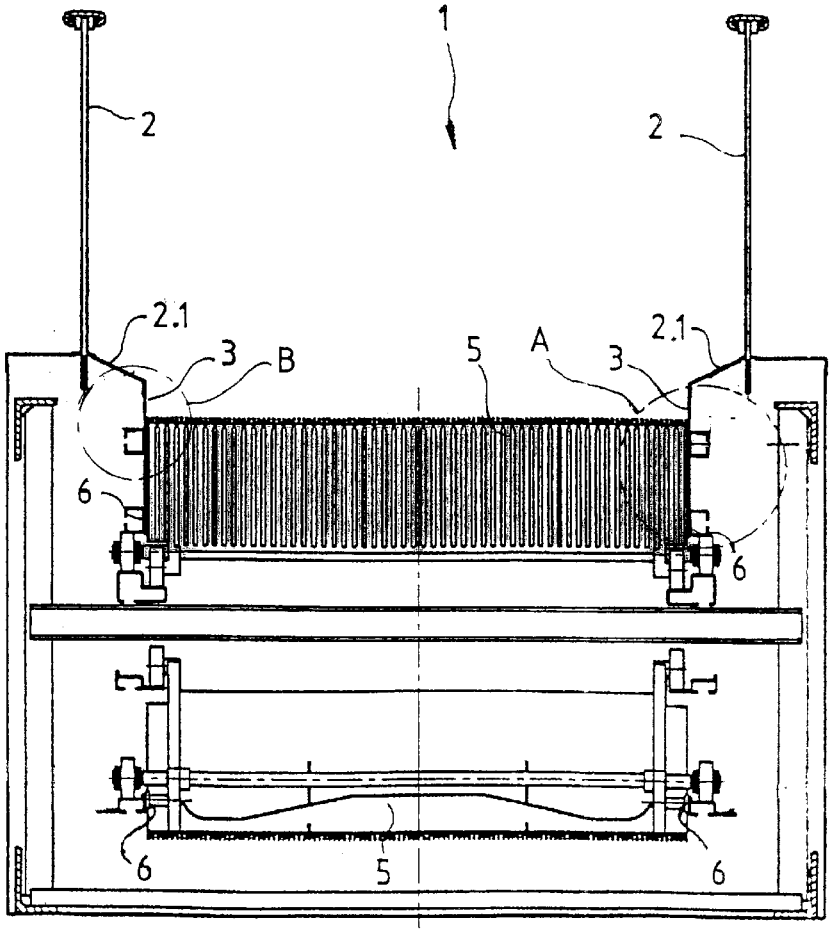
FIG. 2 is a cross-section elevation view taken along the line II—II in FIG. 1.

With initial reference to FIGS. 1 and 2, is escalator 1 has a step belt 4, which consists of escalator steps 5 connected together by means of a transport chain. The step belt is moved and guided in the upper part of the escalator 1 between base plates 3 forming lateral borders for the step belt. The base plates 3 are parts of opposed balustrade bases 2.1, to which a balustrade 2 is fastened. Arranged at the sides of the escalator steps 5 are sliding pads 6, which project slightly (for example, 2 mm) beyond the side edges of the escalator steps 5 so that the step belt 4 is guided between the base plates 3 by means of the sliding pads 6.

Figure 3:
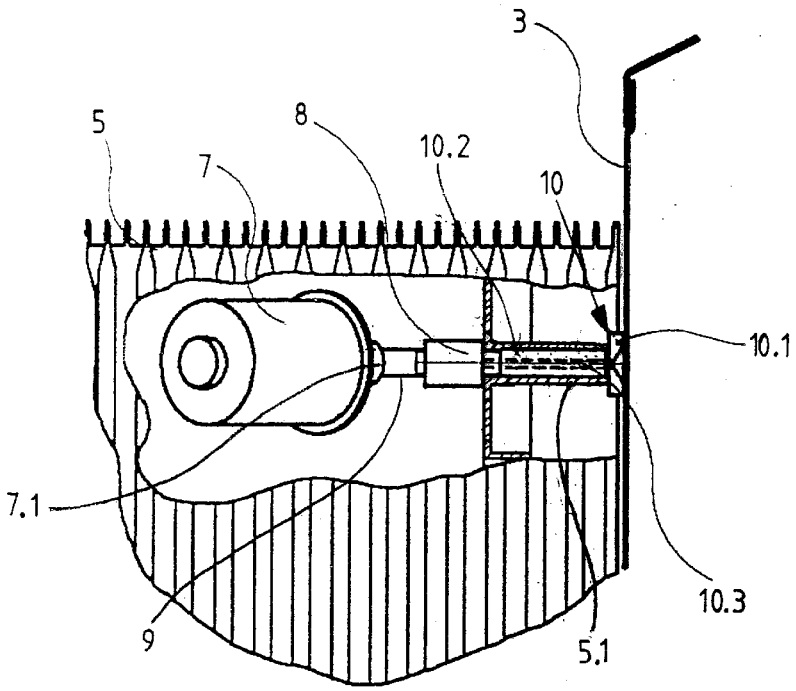
FIG. 3 is a view of a detail "A" of FIG. 2 on an enlarged scale, presenting a first embodiment of the lubricating device according to the invention.
Figure 4:
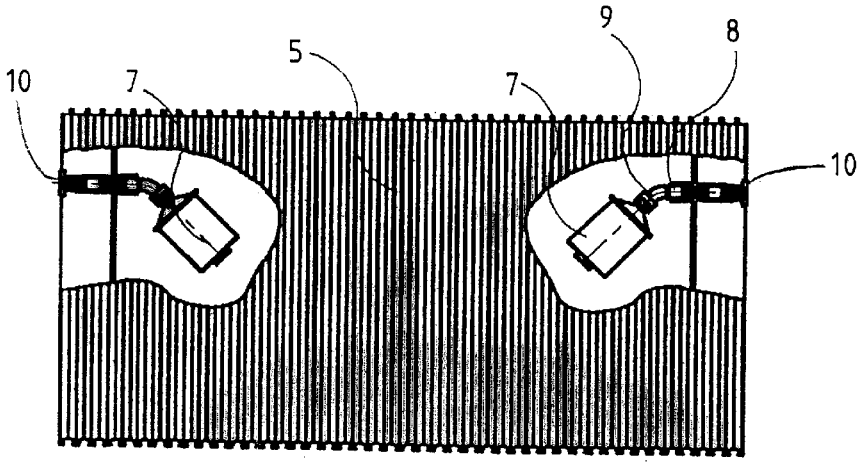
FIG. 4 is a plan view of an escalator step with the lubricating device of FIG. 3.
Figure 5:
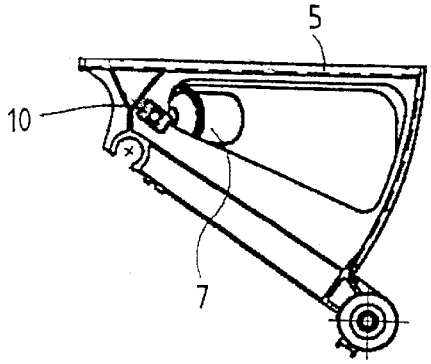
FIG. 5 is a side elevation view of the escalator step.

An escalator step 5 of the step belt 4 or, depending on the length of the particular escalator 1, several escalator steps, has or each have in accordance with FIGS. 3 to 5 two lubricant containers 7, each of which is connected to a dispenser means in the form of a lubricating sliding pad 10 forming a lubrication point at a respective side of the step. The lubricating sliding pads 10 are fastened in sleeve-like receiving parts 5.1 of the escalator step 5, wherein they project, like the sliding pads 6 of the other escalator steps 5, slightly beyond the side edges of the escalator step 5. The lubricating sliding pad 10 has a flange-like guide part 10.1 and a shank 10.2, the distal end of which is threaded. The distal end is screw-connected to a pipe elbow 9 by way of a sleeve 8. The lubricant container 7 has a threaded protrusion 7.1 at its lubricant outlet opening so that it can be screwed to the pipe elbow 9, and is thus retained and supported by the elbow. The lubricating sliding pad 10 has a bore 10.3 which passes through the guide part 10.1 and shank 10.2 and which widens in the guide part 10.1 into a funnel shape towards the base plate 3. During operation of the escalator, the lubricant flows through the bore 10.3 and is transferred to the base plate 3, whereby the sliding pads 6 of the other escalator steps 5 are wetted and lubricated as they pass along the base plate.

Figure 6:
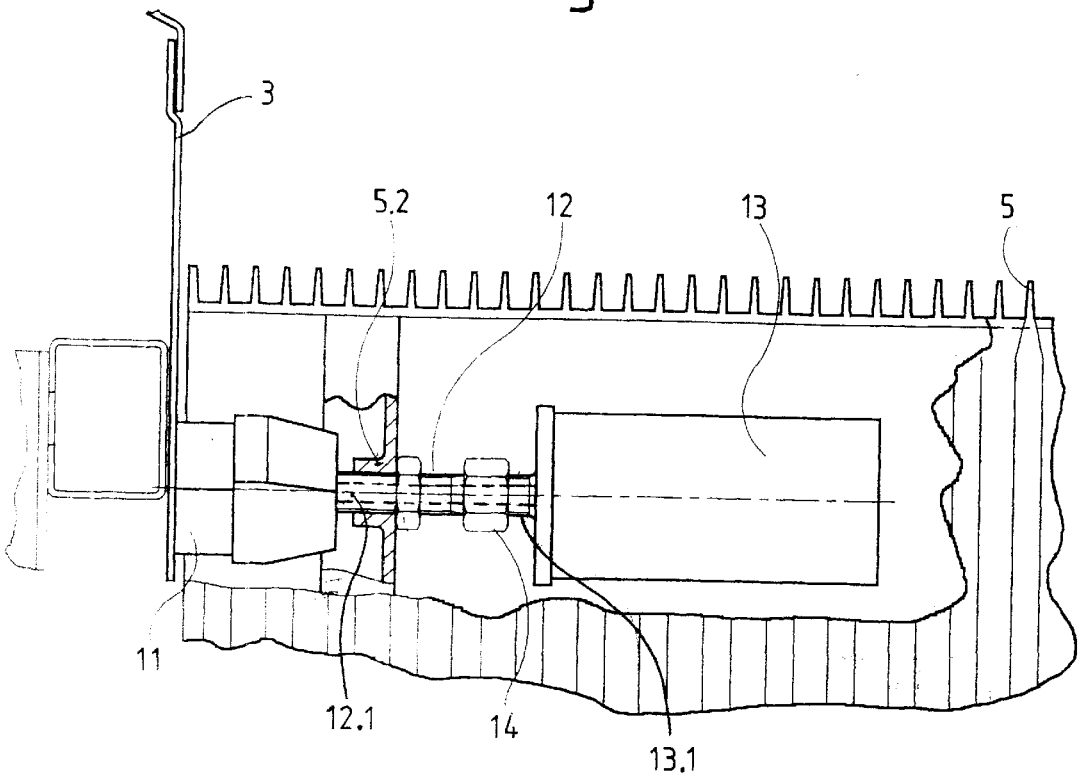
FIG. 6 is a view of detail "B" of FIG. 2 on an enlarged scale, presenting a second embodiment of the lubricating device.
Figure 7:
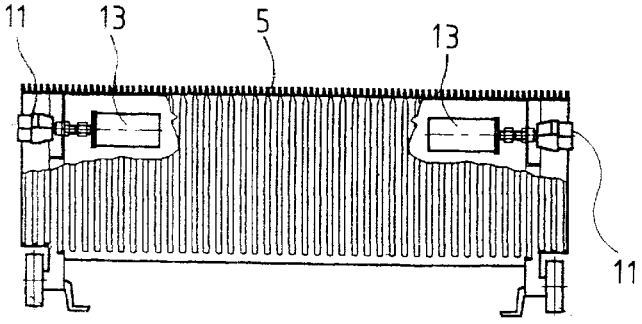
FIG. 7 is an elevation view of an escalator step with the lubricating device according to FIG. 6.
Figure 8:
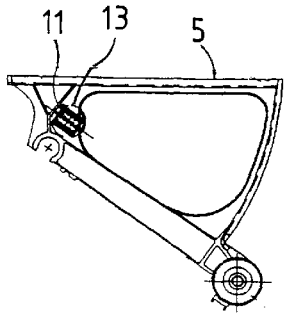
FIG. 8 is a side elevation view of the escalator step.

In the embodiment of FIGS. 6 to 8, the dispenser means are in the form of brushes 11 which are arranged at one escalator step 5 instead of the lubricating sliding pads 10, the brushes projecting slightly beyond the side edges of the escalator step 5 to contact the base plates 3. The brush 11, which can comprise bristles or a porous resilient material, is screwed to a threaded shank 12, which for the purpose of lubricant feed has an internal bore 12.1 and is mounted in a bore-receiving part 5.2 of the escalator step 5. Lubricant container 13 has at its lubricant outlet opening a threaded protrusion 13.1, which is screw-connected with the threaded shank 12 by way of a connecting nut 14, so that the lubricant container 13 is supported and held by the threaded shank 12. During operation of the escalator 1 the lubricant flows through the bore 12.1 of the threaded shank 12 and through a bore in the brush 11 to the bristles and is transferred to the base plate 3. As with the lubricating sliding pads 10 in the other embodiment, the brushes 11 are located in the region of the slide track of the sliding pads 6 of the remaining escalator steps. Containers which automatically meter out the lubricant under pressure may be advantageously used as the lubricant container for both embodiments.

We claim:

1. An escalator wherein a step belt comprising a number of escalator steps is guided between lateral borders and wherein at least one lubricant container is provided at at least one escalator step and is connected to lubrication dispenser means which are affixed to the escalator step and which transfer the lubricant to base plates forming the lateral borders, characterized in that at least a portion of the escalator steps are equipped with narrow sliding guide pads projecting slightly beyond the side edges of the escalator steps for contacting the base plates along a corresponding narrow slide path and guiding the escalator steps between said base plates;

at least one of the escalator steps is equipped with at least one lubrication dispenser means in the form of a lubricating sliding pad which also projects beyond a side edge of the escalator step and is located to transfers lubricant to a path on a base plate which is essentially the same as the narrow slide path; and the height of the slide faces of the sliding guide pads and the lubricating sliding pad is substantially less than the height of the escalator steps.

2. An escalator according to claim 1, characterized in that the lubricating sliding pad is fastened in a receiving part of the escalator step, the lubricating sliding pad comprising a flange-like guide part and a shank, a first end of which is screw-connected to a pipe socket and the lubricant container is screw-connected to a second end of the pipe socket.

3. An escalator wherein a step belt comprising a number of escalator steps is guided between lateral borders and wherein at least one lubricant container is provided at at least one escalator step and is connected to lubrication dispenser means which are affixed to the escalator step and which transfer the lubricant to base plates forming the lateral borders, characterized in that at least a portion of the escalator steps are equipped with sliding guide pads projecting slightly beyond the side edges of the escalator steps for contacting the base plates along a slide path and guiding the escalator steps between said base plates;

at least one of the escalator steps is equipped with at least one lubrication dispenser means in the form of a lubricating brush having a sliding portion which also projects beyond a side edge of the escalator step and is located to transfers lubricant to a path on a base plate which is essentially the same as the slide path; and the height of the slide faces of the sliding guide pads and the sliding portion is substantially less than the height of the escalator steps.

4. An escalator according to claim 3 characterized in that the sliding portion of the lubricating brush is in the form of a brush or a porous resilient material.

* * * * *